US005228494A

United States Patent [19]

Rohatgi

[11] Patent Number: 5,228,494

[45] Date of Patent: Jul. 20, 1993

[54] SYNTHESIS OF METAL MATRIX COMPOSITES CONTAINING FLYASH, GRAPHITE, GLASS, CERAMICS OR OTHER METALS

[76] Inventor: Pradeep K. Rohatgi, 4759 N. Marlbourough Dr., Milwaukee, Wis. 53211

[21] Appl. No.: 876,360

[22] Filed: May 1, 1992

[51] Int. Cl.[5] ..... B22D 19/14; B22D 13/02

[52] U.S. Cl. ..... 164/97; 164/102; 164/103; 164/900; 164/114

[58] Field of Search ..... 164/91, 97, 98, 100, 164/101, 102, 103, 900, 501, 114

[56] References Cited

U.S. PATENT DOCUMENTS

| | | | |
|---|---|---|---|
| 3,678,988 | 7/1972 | Tien et al. | 164/501 |
| 3,929,181 | 12/1975 | Beyer et al. | 164/114 |
| 4,282,922 | 8/1981 | Hartmann | 164/97 |
| 4,423,097 | 12/1983 | Mons et al. | 428/639 |
| 4,473,103 | 9/1984 | Kenney et al. | 164/900 |
| 4,759,995 | 7/1988 | Skibo et al. | 428/614 |
| 4,804,033 | 2/1989 | Hepworth et al. | 164/114 |
| 4,888,054 | 12/1989 | Pond, Sr. | 419/19 |
| 4,977,947 | 12/1990 | Boswell et al. | 164/97 |
| 5,000,247 | 3/1991 | Burke et al. | 164/101 |
| 5,025,849 | 6/1991 | Karmarkar et al. | 164/97 |

FOREIGN PATENT DOCUMENTS

| | | | |
|---|---|---|---|
| 0003864 | 1/1987 | Japan | 164/900 |

*Primary Examiner*—Mark Rosenbaum
*Assistant Examiner*—Erik R. Puknys

[57] ABSTRACT

A method of casting metal matrix composites wherein there is a wide disparity in the respective densities of the metal matrix and the reinforcing particles. The particles are added to a melt of molten metal and the mixture is stirred using an impeller rotating at a high speed so as to ensure an even distribution of the less dense reinforcing particles throughout the denser metal matrix.

16 Claims, No Drawings

SYNTHESIS OF METAL MATRIX COMPOSITES CONTAINING FLYASH, GRAPHITE, GLASS, CERAMICS OR OTHER METALS

FIELD OF INVENTION

This invention relates to synthesis of metal matrix composites where the solid or hollow dispersoids including fly ash, oil ash, glass, graphite or ceramics like silicon carbide or mica or superconducting materials or other metals are introduced individually or in selected combinations in the matrices of a variety of metals including aluminum, magnesium, copper, zinc, lead, silver. The composites can include combinations like metal-fly ash, metal-oil ash, metal-glass, metal-fly ash-graphite, metal-graphite, metal-carbon, metal-graphite-silicon carbide, metal-metal, metal-superconducting oxide. The combinations result in significant decreases in cost of components (for instance, when fly ash or oil ash or silica or glass are introduced in metals) or in significant improvements in properties of metals including improvements in machinability, wear resistance and damping capacity (when graphite and/or fly ash are introduced in metals), or improvements in conducting properties (when highly conducting or superconducting materials are introduced in metals) or improvements in stiffness, strength and abrasion resistance (when fly ash and/or silicon carbide or higher melting metals are introduced in matrix metals) or decreases in density (when lighter dispersoids, including hollow particles or fibers like fly ash or glass or carbon or silicon carbide are introduced in metals). An example of a useful composite could include a lead based composite with fly ash and aluminum which will have very low densit compared to monolithic lead alloys.

SUMMARY OF INVENTION

These processes of this invention involve adding heated uncoated particles, fibers or whiskers along with a reactive element or coated particles, into a bath of molten alloy, under inert gas cover, in a crucible using an impeller rotating at high speeds, and/or ultrasonic vibrations of optimum frequency and amplitude and casting the mixture of molten alloy metal and suspended particles, also referred to as a slurry, into suitable molds, including static and rotating molds under specific conditions resulting in an improved product. The process of the invention prefers bottom pouring through a hole in the crucible bottom, while stirring is continued, especially when density differences between the metal and dispersoid are high as in the case of copper and graphite, or metals and hollow additives, and pouring in metal molds or sand molds with enlarged gating and runner system. The processes of this invention also include packing solid or powders or fibers or whiskers of uncoated or coated fly ash or oil ash, or glass, or graphite or carbon, or other metals like tungsten or aluminum or superconducting ceramics, or a mixture of these individual materials, bringing the bed to a suitable temperature, and pressure infiltrating the bed with molten alloy of metals like aluminum, copper, lead, zinc, which preferably contains a reactive element which reduces infiltration pressure and facilitates infiltration. Examples of composites made using infiltration include aluminum-graphite, copper-graphite, lead-fly ash, lead-aluminum and several other combinations. The stir casting process is more suitable for making composites which contain up to 30 volume percentage of particulate dispersoids whereas pressure infiltration is more suitable for making composites which contain over 30 volume percentage, up to even 70 volume percent dispersoids.

The processes of this invention have been reduced to practice to make several composites including aluminum-fly ash, aluminum-oil ash, aluminum-graphite (particles, fibers, hollow microspheres), aluminum-fly ash-graphite, aluminum-graphite-silicon carbide, aluminum mica, aluminum-silica, copper-fly ash, lead-fly ash, copper-graphite, zinc-fly ash, zinc-graphite, magnesium-graphite, aluminum-Yttrium Barium Copper superconducting oxide, aluminum-glass (solid or hollow). The process of this invention has also been used to disperse higher melting metals in the matrix of lower melting metals; for instance, copper, aluminum and iron have been dispersed in lead alloys. The aluminum-fly ash, aluminum-fly ash-graphite, aluminum-mica, aluminum-graphite, aluminum silicon carbide and aluminum-glass composites were also centrifugally cast in rotating permanent molds to segregate graphite, fly ash, mica and glass particles to the inner periphery of cast cylinders and silicon carbide particles to the outer periphery of the cast cylinder. Aluminum-graphite fiber composites and magnesium-graphite fiber composites were made by placing preforms of coated graphite fibers or particles in a rotating cylindrical mold and infiltrating it with molten metal poured into optimally preheated molds rotating at requisite speeds with the melt at the requisite superheat, poured in an optimum pouring pattern with selected mold coatings. The composites made using the processes of this invention have comparable or better properties than composites of similar composition made by other processes. For instance the aluminum-fly ash composite made by the processes of this invention exhibit greater improvement in wear resistance compared to similar composites made by powder metallurgy processes. The casting technique proposed in this investigation will also be less expensive compared to the powder metallurgy processes which are more expensive and require the production of powders of the matrix material. The casting process of this invention will also be better than the other processes described previously which do not use the specific embodiments of this invention. For instance, centrifugally cast composites made according to the embodiments of this invention will have reduced porosity and uniform thicknesses of dispersoid rich region.

DESCRIPTION OF PREFERRED EMBODIMENTS

This invention covers inexpensive casting techniques which have been developed to produce Metal-Fly Ash composites containing substantial percentages of both as received and classified fly ash powders, oil ash powders, alone, or in combination with other dispersoids like graphite or silicon carbide. The invention also covers casting techniques to disperse particles like graphite or mica or glass or silica or superconducting materials or other metals, individually or in selected combinations in the matrix of metals and alloys. The fly ash frequently contains carbon or graphite particles along with the solid or partly hollow particles of oxides of aluminum, silicon and iron. The technique involves creating a melt of the alloys in which fly ash and/or graphite or mica, or glass or silica or other ceramics or other metals are to be incorporated, for instance, melts of aluminum alloys, copper alloys, zinc alloys, magnesium base alloys, iron base alloys, lead base alloys, tin base alloys, in a crucible and stirring heated particles or fibers of fly ash and/or graphite, and/or silicon carbide, and/or glass or silica, and/or superconducting materials and/or other metals or ceramics in these melts in completely liquid or semi-solid states, using high velocity impellers in the presence of baffles, the heated fly ash and/or graphite particles are added to the surface of the melt and the melt is stirred by an impeller immersed in the melt and rotating at a high speed, generally above 600 rpm, while a reactive element is added to the surface of the melt or is present in the melt in the presence or in the absence of ultrasonic energy introduced into the bath while stirring or pouring the melt. For aluminum alloys, the reactive element was found to be magnesium which facilitates the dispersion of fly ash and/or graphite particles and/or mica or glass or silica particles into aluminum alloys; for copper base alloys the reactive element was titanium, and for zinc base alloys the reactive elements were aluminum and silicon. The suspension of fly ash particles and/or graphite particles or fibers and/or silicon carbide particles, and/or glass or silica or mica particles, and/or superconducting materials or other metals, in molten alloys or semisolid alloys of aluminum, copper, zinc or other metals created by stirring of these dispersoids in the melt is referred to as a slurry. This slurry is poured into suitable molds, sand or permanent static molds with or without simultaneous application of pressure, or rotating molds to solidify the molten alloy, resulting in a composite of solidified metal containing dispersed particles of fly ash or oil ash, or mixture of ash and graphite or other particles, whiskers and fibers, including graphite, mica, glass, silica or other metals like aluminum or tungsten or superconducting materials. The important elements of the invention are addition of dispersoids like graphite, or silicon carbide, or addition of graphite particles or silicon carbide or refractory metals or superconducting oxides individually or in combination with other dispersoids, after being heated at a suitable temperature to the surface of an alloy melt which is being stirred using an impeller rotating at a high speed, generally in excess of 600 rpm, in the melt, in the presence of a baffle preferably in the presence of a reactive element added to the melt (magnesium to aluminum, titanium to copper) or adding suitably coated particles, for instance metal coated particles including nickel or copper coated particles or particles coated with oxides like Zirconia. It is also preferred that a blanket of inert gas be maintained on the surface of the melt to prevent oxidation of the melt while it is being stirred; it is also preferred that a cover be placed on the crucible containing the metal while the metal is being stirred, to avoid spilling of the metal and to assist in maintaining a gas blanket. Alternately a vacuum can be maintained above the melt surface. It is also preferred that the melt be agitated using ultrasonic vibration of suitable frequency and amplitude during the addition of the particles or fibers to the melt or during its solidification in the molds.

Using the method of this invention, composite ingots of aluminum-fly ash, aluminum-oil ash, aluminum-fly ash-graphite, copper alloy-fly ash, lead alloy-fly ash, zinc alloy-fly ash, aluminum-graphite (particles and fibers), aluminum-glass, aluminum-mica, aluminum-silica, copper graphite, aluminum-CuBaY oxide have been produced. The invention also includes centrifugally casting suitably superheated aluminum alloy-fly ash, aluminum alloy-fly ash-graphite, aluminum-graphite, aluminum-mica, aluminum-glass composite melts and copper graphite melts in heated rotating permanent molds, suitably insulated, to produce cylinders where fly ash and/or graphite, or mica or glass are segregated to the inner periphery of the cast cylinders, giving selective reinforcement.

SPECIFIC EXAMPLES

Metal Matrix Composites With Fly Ash

The process of this invention which involves bringing the melts of alloys to a molten or semi solid state, in a crucible, adding a wetting agent like magnesium (at least about 0.5% by weight of the aluminum, but preferably above 1%) along with fly ash (heated to a temperature of about 1200° F.) and/or graphite particles, to the surface of the melt while it is stirred under a cover with argon blanket using an impeller immersed in the melt, and rotating at speeds at least above 600 r.p.m., preferably above 1200 r.p.m. in the presence of a baffle to break the flow of metal near the crucible wall, leads to an aluminum-fly ash particle composite (with at least 5 vol. % of fly ash, preferably above 20 vol. % of fly ash or aluminum-graphite composite or aluminum-fly ash-graphite composites which have improved properties.

For instance, the uniqueness of the above process is illustrated from the following specific examples:

EXAMPLE 1

When fly ash particles in the range of 5–400 microns at room temperature were added to the surface of a melt at rates of 5 grams per minute to 400 grams per minute of an aluminum alloy without any magnesium and the melt was agitated using a graphite rod, no significant amount of fly ash could be incorporated into aluminum alloys. Similar experiment was carried out in which uncoated graphite or nickel or copper coated graphite were stirred alone or in combination with fly ash were stirred in the melts of aluminum alloys, and no significant quantities of graphite or fly ash could be incorporated into aluminum alloys.

EXAMPLE 2

When fly ash particles in the range of 5 to 400 microns at room temperature were added to the melt of aluminum alloys without any magnesium and the melt was stirred using an impeller immersed in the melt rotating at speeds of the order of 1200–2200 rpm in the presence of baffles, no significant amount of fly ash could be incorporated in the aluminum alloys.

EXAMPLE 3

When fly ash particles in the range 5–400 microns heated to 1300° F. were added at a rate of 70 grams per minute to the surface of an aluminum alloy melt, without any magnesium, and the melt was stirred using an impeller rotating at a speed of 1200–2000 rpm, no significant amount of fly ash could be incorporated in aluminum alloys.

EXAMPLE 4

When 5 volume percent fly ash particles in the range of 5–400 microns heated to a temperature of 1300° F. were added at a rate of 70 gram/minute to the surface of an aluminum alloy melt at a temperature of 1350° F., along with magnesium pieces weighing a total of 1% by weight of the melt, and stirred using an impeller immersed in a melt rotating at a speed of 1200–2000 rpm with a cover on the surface of the melt through which argon gas was being introduced, all the fly ash particles could be introduced in the melt of aluminum alloys and retained in uniformly dispersed form in the cast aluminum alloys after solidification in permanent molds.

EXAMPLE 5

When 10 volume percent fly ash particles in the range 5–400 microns heated to a temperature of 1300° F. were added at a rate of 70 grams/minute to the surface of an aluminum alloy melt in a crucible at a temperature of 1350° F., along with pieces of magnesium weighing a total of 2% by weight of the melt and stirred using an impeller rotating in a speed range 1200–2000 rpm in the presence of a baffle and a cover over the melt through which argon gas was blown over the melt, all the 10 volume percent fly ash particles could be introduced in the melt of aluminum alloys and retained in a uniformly dispersed form in the cast aluminum after solidification.

The aluminum alloy 10% fly ash composite cast in this manner was tested for its wear resistance against a rotating disk on which emery paper was pasted. Under identical wear tests, the wear of aluminum-alloy-10% fly ash composite was 3 gm compared to a wear of 18 gm for the same aluminum alloy without any fly ash; this represents an increase in wear resistance by a factor of six by incorporation of fly ash. This indicates considerably larger increases in wear resistance of aluminum alloys obtained by additions of fly ash using the process of the present invention compared to what was obtained in composites made by other processes. The additions of fly ash to aluminum base alloys by the process of present invention also leads to large increases in the hardness and elastic modulus of the aluminum base alloys. Since fly ash is a waste byproduct of utility industry, its incorporation using the inexpensive process of present invention decreases the cost of aluminum castings by replacing energy intensive aluminum while increasing the hardness, elastic modulus and wear resistance of aluminum alloys.

EXAMPLE 6

When 15 volume percent fly ash particles in the range 5 to 400 microns heated to a temperature of 1300° F. were added at a rate of 70 grams/minute to the surface of aluminum alloy melt in a crucible at a temperature of 1350° F., along with pieces of magnesium weighing a total of 3% by weight of the melt and stirred using an impeller rotating in a speed range 1200–2000 rpm in the presence of a baffle and a cover over the melt through which argon gas was blown over the melt, all the 15 volume percent fly ash particles could be introduced in the melts of aluminum alloys and retained in a uniformly dispersed from in the cast aluminum after solidification.

EXAMPLE 7

When 20 volume percent fly ash particles in the range 5 to 400 microns heated to a temperature of 1300° F. were added to the surface of aluminum alloy melt in a crucible at a temperature of 1350° F., along with pieces of magnesium weighing a total of 3% by weight of the melt, and stirred using an impeller rotating in a speed range 2500 to 4500 rpm in the presence of a baffle, and a cover over the melt through which argon gas was blown over the melt, all the 20 volume percent of the fly ash particles could be introduced in the melt of aluminum alloys and retained in a uniformly dispersed form in the cast aluminum alloy after solidification in permanent molds.

EXAMPLE 8

In an example similar to example 7, except where the impeller speed was below 1500–2500 rpm it was not possible to introduce 20 volume percent fly ash in aluminum alloy melts. Only when the impeller speed was increased in the range 2500–4500 rpm, 20 volume percent fly ash could be introduced in the alloy, demonstrating the requirement of impeller speeds above 2500 rpm when over 20 volume percent fly ash is to be introduced in aluminum alloy melts and in solidified aluminum alloys.

EXAMPLE 9

In four separate experiments similar to example 7 except where fly ash of four different sizes, a. −100 mesh+200 mesh, b. −200 mesh, c. +300 mesh, d. −300 mesh+400 mesh, and −400 mesh were introduced in aluminum alloy melts, it was possible to introduce all four size ranges of fly ash in aluminum alloy melts and retain them in the castings. However microstructural observation showed that finer the size of fly ash, the better is the distribution of the fly ash. The mechanical properties and physical characteristics of the alloys, including secondary processing characteristics like machining, were also superior when finer sizes of fly ash were introduced compared to the case when similar quantities of coarser sizes of fly ash were introduced.

EXAMPLE 10

The experiment similar to example 7 was repeated with oil ash, which is a byproduct of oil combustion for energy generation instead of coal combustion. Using the process similar to example 7, it was possible to make a composite of aluminum-oil ash, indicating that oil ash particles can be dispersed in aluminum alloys in a manner similar to fly ash.

EXAMPLE 11

In an experiment 5 volume percent uncoated graphite particles were added along with 10 volume percent fly ash particles to a melt of aluminum alloys using a method similar to that given in example 7. It was found possible to disperse both fly ash and graphite particles and retain them in the matrix of cast aluminum alloys. Part of the aluminum melt to which fly ash and graphite were added was superheated to above 1350° F. poured in a heated rotating steel mold for centrifugal casting; as a consequence of centrifugal casting, both the graphite and fly ash had segregated to the inner periphery of the cast cylinder. Such a cylinder can be used as a cylinder liner. This experiment was repeated with additions of nickel coated graphite particles along with fly ash particles to the melt, with similar results.

The above examples indicate that substantial quantities of fly ash, say above 5 volume percent, preferably above 20 volume percent, can be introduced in molten alloys like aluminum base alloys either alone or in combination with other particles like graphite, and retained in a uniformly dispersed state in the casting only under certain combinations of process conditions which involve:

i. Preheating of fly ash to temperature close to molten aluminum or preheating fly ash in combination with carbon or graphite particles.

ii. Adding magnesium pieces above 1%, preferably above 2% and close to 3%, to the aluminum alloy melt along with the fly ash powder or fly ash powder in combination with graphite or carbon powder.

iii. Adding particles to the melt while stirring the melt using an impeller rotating at high speeds above 600 rpm, preferably above 1200–2500 rpm, more preferably cose to 4000 rpm, in the presence of a baffle while the melt has a cover with a hole through which argon gas is introduced over the surface of the melt. A preferred embodiment is agitating the melt using ultrasonic vibration during stirring or during casting of the melt.

iv. Adding fly ash particles below 100 mesh size, preferably below −200 mesh size and more preferably below −300 mesh size, to obtain a more uniform distribution and greater improvements in mechanical and physical characteristics, and secondary processability.

v. Preferably solidifying molten aluminum-fly ash slurry in a permanent metal mold where fly ash has less time for floatation in the melt. Pouring of the metal-fly ash slurry can be from the lip of the crucible or preferably bottom pouring through a hole in the bottom of the crucible, while stirring is continued.

vi. Centrifugally casting the molten aluminum-fly ash slurry in a rotating mold to segregate fly ash to the inner periphery of cylindrical castings. Alternately centrifugally casting molten aluminum-fly ash-graphite slurry in a rotating mold to segregate fly ash and graphite to innder periphery of the cylindrical casting.

EXAMPLE 12

The process of this invention involving stirring a bath of molten metal using an impeller rotating at high speeds and adding heated particles along with a reactive element to form a metal matrix-ash composite has also been extended to copper base alloy composites. As an example, it was possible to disperse 10 weight percent fly ash in a C903 copper alloy melt at a temperature of 1250° C., and retain it in castings when 1% of reactive element titanium was added to the surface of the melt along with the fly ash while the impeller was rotating at 2500–4000 rpm, the melt was poured either using lip pouring or more preferably, using bottom pouring through a hole in the bottom of the crucible while stirring was continued. In the absence of titanium under similar conditions, it was not possible to disperse fly ash particles.

The process of this invention is not obvious from the prior art which principally describes a process of mixing of solid powders of aluminum and fly ash and pressing them and sintering them or mixing fly ash to molten aluminum alloys without mentioning the need of the reactive elements like magnesium above 0.5 to 1%. The need for preheating the fly ash to molten metal temperature, the need for stirring the molten metal using an impeller rotating at speeds above 600 rpm in the presence of baffle, the need to cover the melt and the need to maintain an inert gas blanket over the surface of the melt.

The process of this invention also leads to a more uniformly dispersed particles which are well bonded to the matrix, leading to much greater improvements in the hardness, wear resistance and modulus of the aluminum alloys.

The process of this invention has been successfully used to disperse fly ash in the matrix of aluminum, zinc base alloys and copper base alloys, and it can be used to disperse fly ash in the matrix of other alloys like magnesium, lead, tin, silver, which have melting points lower or similar to fly ash. The process of this invention has also been successfully used to disperse a mixture of fly ash and carbon or graphite (both coated and metal coated graphite) in the matrix of metals like aluminum. The process of this invention in experiments is similar to that given in example 7 has also been used to disperse particles of mica, solid or hollow microspheres or fibers of glass. The process of this invention has also been used to successfully disperse uncoated or metal coated graphite in the matrix of alloys of aluminum, magnesium, copper, zinc, tin and lead. The process of this invention has also been used to disperse of iron or copper in lead and superconducting oxides in aluminum.

EXAMPLES OF INTRODUCTION OF SILICON CARBIDE PARTICLES IN ALUMINUM ALLOYS TO MAKE ALUMINUM-SILICON CARBIDE COMPOSITES

EXAMPLE 13

Ten pounds of aluminum alloy was brought to a molten state at a temperature of 700° C. and 20 volume percent silicon carbide particles or platelets of size 20 microns were added to the surface of the melt while the melt was being agitated with an impeller rotating at a speed equal to or greater than 600 rpm. During the mixing most of the silicon carbide particles or platelets were rejected and the silicon carbide particles retained in the melt were frequently agglomerated in the microstructure.

EXAMPLE 14

Ten pounds of aluminum alloy was brought to a molten state at a temperature of 700° C. and 20 volume percent silicon carbide particles or platelets of size 20 microns, preheated to temperatures in the range 400°–700° C. for four hours were added to the surface of the melt while the melt was being stirred at 1000 rpm under an argon blanket under a cover. Magnesium pieces weighing about 2% of the weight of the melt were added along with the silicon carbide to the surface of the melt along with the powder. The mixture of aluminum alloy melt and silicon carbide powder was poured into permanent molds using either lip pouring or bottom pouring and the castings showed reasonably uniform distribution of silicon carbide in the matrix of aluminum alloys.

EXAMPLE 15

The mixture of molten aluminum and silicon carbide particles or platelets was created in a manner similar to the above example except that ultrasonic vibrations at a frequency of 1000 Hertz with an amplitude of one thousandth of an inch was applied to the melt. This resulted in considerable improvement in the distribution of silicon carbide in the casting.

EXAMPLE 16

The mixture of molten aluminum and silicon carbide particles created by the method of Example B, was poured at 200° C. superheat into a steel mold preheated to 300° C. and coated on the inside with insulating refractors, rotating at 1900 rpm. The resulting casting showed silicon carbide particles segregated to the outer periphery of the hollow cylindrical casting without the presence of porosity in the system.

Pressure Infiltration:

The processes of this invention also include pressure infiltration of dispersoids like fly ash, graphite, mica, glass in particle, fiber or microsphere form or superconducting materials in powder form by metals like aluminum, copper, silver, zinc, lead, magnesium or their alloys. In the following, examples are given which indicate that pressure infiltration works at lower pressures when the processes of this invention are used. The ability to infiltrate at lower pressures using processes of this invention is definitely advantageous.

EXAMPLE 17

Fly ash particles of average size 75 microns were packed in the form of 3" high bed in a 6 mm diameter quartz tube and heated to 700° C. while one end of the quartz tube was immersed in a crucible of molten aluminum alloy, heated to 750° C., placed in a pressure chamber. The pressure chamber was pressurized to a pressure of 125 psi and the pressure was held for six minutes. Even after six minutes pressurization, there was no infiltration of the bed of fly ash with molten aluminum alloy.

EXAMPLE 18

When an experiment described in example 17 was repeated under identical conditions, except for the addition of 2 weight percent magnesium to molten aluminum alloy, application of a pressure of 125 psi was sufficient for infiltration of the bed of fly ash resulting in a composite with 40% fly ash dispersed in aluminum alloy matrix. A comparison of examples A and B indicates that infiltration of fly ash with molten aluminum to make composites is not obvious in the art. Unless specific conditions which are part of this invention are present the infiltration does not occur and no composite is formed. Here the conditions include presence of magnesium which facilitate infiltration under conditions it was otherwise not possible.

EXAMPLE 19

While most of the examples in this patent are of fly ash being either stirred into a melt or infiltrated by molten metal to form a composite, the invention was also reduced to practice with oil ash particles. Oil ash is also a waste byproduct, like fly ash, only it is a byproduct of burning oil for energy generation. The experiment described in example 18 was repeated with oil ash instead of fly ash particles and a composite of aluminum-oil ash could be made. The experiment described in example 18 was repeated with mica, glass fibers, YBaCu oxide, SiC particles, SiC platelets, glass and carbon microbaloons, and nickel, copper and $ZrO_2$ coated silicon carbide particles. In each case it was possible to make composites and reduce infiltration pressure through the use of either reactive elements like magnesium in the melt or coatings of metals like copper, nickel or oxides like $ZrO_2$, $SiO_2$ or $TiO_2$ on particles, platelets or fibers.

WROUGHT OR MECHANICALLY WORKED ALLOYS

The cast metal-fly ash composites or metal-graphite or metal-graphite-fly ash synthesized using the process of this invention can also be subsequently hot worked and/or cold worked to produce wrought versions of these alloys in desired shapes with improved properties.

EXAMPLE 20

As an example a casting aluminum base alloy with 10 volume percent fly ash particles in a 15 cm diameter, 25 cm long ingot form could be extruded at temperatures in the neighborhood of 480° C. using an extrusion ratio of 37:1. The process of extrusion led to a three-fold improvement in the tensile strength properties over that of the properties of the cast ingot.

The composites reduced to practice by the processes of this invention include:

1. Sand cast and permanent mold cast metal-fly ash composites including aluminum-fly ash, copper fly ash, zinc-fly ash.
2. Centrifugally cast aluminum-fly ash composite cylinders where fly ash particles are concentrated near the inner periphery of the hollow cylindrical casting.
3. Centrifugally cast aluminum-fly ash-graphite composite cylinders where fly ash and graphite particles are concentrated near the inner periphery of the hollow cylindrical casting.
4. Centrifugally cast aluminum-graphite composite cylinders where graphite particles were concentrated near the inner periphery of the cylinder. Special process modifications including melt superheat and mold preheating were required to obtain uniform thickness of graphite rich layer near the inner periphery and to minimize porosity.

EXAMPLE 21

A 10 pound melt of copper alloy 903 was produced in a crucible and graphite particles were introduced in the melt along with titanium as a reactive element, and the melt was lip poured or bottom poured, while stirring was continued, into sand or permanent molds. The bottom pouring while stirring was continued, resulted in a much better distribution of graphite in the castings, as compared to the case when top pouring was used. Permanent mold castings of copper-graphite slurry showed much better distribution of graphite compared to thick section sand castings where graphite tended to float and segregate near the top of the casting. To get uniform distribution of graphite in sand castings it was necessary to widen the runner system and gates in the mold. Without widening the gates, it was not possible to introduce graphite in the mold cavity.

EXAMPLE 22

A melt of aluminum-silicon alloy was made in a crucible and brought to a temperature of 1300° F. When uncoated or nickel coated graphite powder was added to the surface of this melt and hand stirred using a graphite rod, it was not possible to introduce any substantial quantities of graphite in the melt and retain it in the casting.

EXAMPLE 23

A melt of aluminum-silicon alloy was made in a crucible under conditions similar to example 22 and brought to a temperature of 1300° F. The melt was stirred using an impeller rotating in the speed range of 600 rpm to 1250 rpm and and nickel coated graphite was added to the surface of the melt under an inert gas blanket. Under these conditions, the graphite particles could be dispersed in the melt and retained in the castings after solidification of the melt in sand and permanent molds.

This example, and example 22, demonstrates the need to stir the melt at high speeds using an impeller under an inert gas blanket while adding nickel coated graphite particles.

EXAMPLE 24

A melt of aluminum-silicon alloy was made in a crucible under conditions similar to example A and B and brought to a temperature of 1300° F. The melt was stirred using an impeller rotating in the speed range of 600 rpm to 1250 rpm and uncoated graphite powder, heated to 400° F., was added to the surface of the melt along with 1% magnesium under an argon blanket. These conditions including stirring by impeller and the additions of magnesium along with uncoated graphite powder, heated to 400° F., led to dispersion of graphite particles in the melt and their successful retention in the castings.

I claim:

1. A method for casting a metal matrix composite wherein one or more reinforcing particles selected from the group comprising graphite, fly-ash, oil-ash, and hollow microspheres are added to a matrix metal, said method comprising the steps of;

a) heating the metal matrix to provide a melt, b) stirring the melt using an impeller, c) adding the reinforcing particles to the melt, d) pouring the metal matrix-particulate melt into a mold while continually stirring the melt, whereby the impeller is rotated at a speed of at least 1000 rpm so as to ensure an even distribution of the less dense reinforcing particles throughout the denser metal matrix.

2. The method of claim 1 wherein, the stirring is performed in the presence of a baffle.

3. The method of claim 1 wherein, the stirring is performed in an inert atmosphere.

4. The method of claim 1 wherein, the particles are preheated prior to adding them to the melt.

5. The method of claim 1 wherein, the particles are coated prior to adding them to the melt.

6. The method of claim 1 wherein, the mold is a static sand casting mold.

7. The method of claim 1 wherein, the mold is a permanent casting mold.

8. The method of claim 1 wherein, the mold is a rotating centrifugal casting mold, whereby the particles segregate due to density differences to the inner periphery of the casting.

9. The method of claim 1 wherein, the mold is a continuous casting mold.

10. The method of claim 1 wherein, the pouring step comprises bottom-pouring the melt.

11. The method of claim 1 wherein, the metal matrix material is selected from the group comprising aluminum, magnesium, copper, zinc, lead, tin, iron or alloys thereof.

12. The method of claim 1 wherein, a reactive element is added to the melt,

13. The method of claim 12 wherein, the reactive element is selected from the group comprising magnesium, titanium, lithium, zirconium, chromium, calcium or sodium.

14. The method of claim 5 wherein, the coating is selected from a group comprising nickel, copper, chromium, titanium, aluminum, zinc, silica, titania, or zirconia.

15. The method of claim 1 wherein, the impeller is rotated at a speed of between 2000 and 4000 rpm.

16. A method for casting a metal matrix composite wherein the metal matrix/reinforcing particle composite is selected from the group comprising copper/-CuBaY oxide, copper/silicon carbide, zinc/silicon carbide, lead/silicon carbide, iron/silicon carbide, aluminum/hollow silicon carbide, magnesium/hollow silicon carbide, copper/glass, zinc/glass, lead/glass, tin/glass, and iron/glass, said method comprising the steps of;

a) heating the metal matrix to provide a melt, b) stirring the melt using an impeller, c) adding the reinforcing particles to the melt, d) pouring the metal matrix-particulate melt into a mold while continually stirring the melt, whereby the impeller is rotated at a speed of at least 1000 rpm so as to ensure an even distribution of the less dense reinforcing particles throughout the denser metal matrix.

* * * * *